United States Patent [19]

John

[11] Patent Number: 4,741,447

[45] Date of Patent: May 3, 1988

[54] LINERLESS CAP CLOSURE

[75] Inventor: Christian J. John, Downers Grove, Ill.

[73] Assignee: American National Can Company, Chicago, Ill.

[21] Appl. No.: 43,106

[22] Filed: Apr. 27, 1987

[51] Int. Cl.[4] ..... B65D 41/34; B65D 53/00

[52] U.S. Cl. ..... 215/252; 215/344; 215/DIG. 1

[58] Field of Search ..... 215/252, 344, 345, 343, 215/DIG. 1

[56] References Cited

U.S. PATENT DOCUMENTS

| | | | |
|---|---|---|---|
| 4,489,845 | 12/1984 | Aichinger et al. | 215/344 X |
| 4,526,282 | 7/1985 | Dutt et al. | 215/252 |
| 4,530,436 | 7/1985 | Wiedmer | 215/252 X |
| 4,564,112 | 1/1986 | Breuer | 215/252 X |
| 4,664,279 | 5/1987 | Obrist et al. | 215/252 |
| 4,667,838 | 5/1987 | Yeager | 215/252 |

*Primary Examiner*—Donald F. Norton

*Attorney, Agent, or Firm*—Robert A. Stenzel; Ralph R. Rath

[57] ABSTRACT

A linerless cap closure includes circular top wall and a depending annular skirt having an internal thread with a tamper-evident band below the skirt. A sealing member is integral with the lower surface of the top wall and includes an annular protrusion having a depending annular axial projection. The tamper-evident band is connected to the skirt with a plurality of spaced tear tangs and a permanent connection and the band has an inwardly-directed bead with inclined ramps extending from the inner edge of the bed to the lower edge of the bead.

3 Claims, 1 Drawing Sheet

LINERLESS CAP CLOSURE

DESCRIPTION

Technical Field

The present invention relates generally to taper-evident closures of plastic material for sealing containers of various types, such as plastic bottles.

BACKGROUND OF THE INVENTION

Both plastic and metal closures for various bottles and containers which include a taper-evident feature have been known for many years. In most cases, the tamper-evident feature comprises a lower shoulder or skirt portion which is intended to be separated or fractured from the remainder of the closure upon removal of the closure from the container so that it becomes evident that the container has been opened. In the past, the majority of such types of closures have been predominantly made of metal; however, the use of metal has resulted in significant problems, which relate primarily to the fact that removal of the closure does not result in a clean and efficient fracture of the lower skirt portion. Also, in some instances, sharp edges are created that cause a danger to the user.

In connection with plastic closures of this type, again, a large number have been patented in the past. Exemplary of one type of closure is shown in U.S. Pat. No. 4,033,472. The closure in this patent requires a two-step application procedure which includes the initial application of the closure to the bottle, followed by a heating process whereby the lower depending bead is deformed against the surface of the bead or collar on the bottle itself.

When the cap closure is formed of a plastic material, the liner normally applied to the inner surface of the closure is generally eliminated and a sealing means is formed integral with the bottom surface of the circular top wall. Many of the linerless closures available commercially rely upon deflection of a flexible fin depending from the top wall of the closure. The lateral flexing movement of the fin tip is designed to cause the tip of the fin to move into sealing engagement with an edge of the container finish. However, this created problems in that the sealing portion of the closure will lose its elastic memory after storage for a period of time and then tends to reduce the sealing force. Thus, the seal may be lost.

SUMMARY OF THE INVENTION

According to the present invention, linerless cap closures have been developed having a sealing means which can be easily molded and which also include a tamper-evident feature. More specifically, the linerless cap closure consists of a generally circular top wall with a depending annular skirt or side wall having an internal thread adapted to engage with an external thread on a container neck and sealing means depending from the lower surface of the top wall adjacent the annular skirt. The sealing means includes a first annular rib integral with the lower surface and being generally rectangular in cross-section and an annular projection integral with the rib adjacent the outer wall with the projection having an outer wall defining an extension of the outer wall of the rib and an arcuate inner wall merging with the outer wall through a reduced radiused portion, so that upon threading of the closure onto a container neck, the inner wall of the projection will engage and slide along the outer edge of the container neck to provide a seal and the bottom wall of the rib will engage a top surface of the container neck to aid in the sealing of the container.

According to one aspect of the invention, the linerless cap closure also has a tamper-evident band which extends below the annular skirt and is connected thereto by a frangible connection. The band has a main body that has an inwardly-directed bead intermediate upper and lower edges with the bead defining an upwardly-directed shoulder adapted to engage an underside of a rib on the container neck. The band also has ramp means extending between an inner edge of the bead and a lower edge of the main body for guiding the bead over the rib on the container neck while the closure is threaded onto the container.

There is also provided a permanent connection between the annular skirt and the band so that the band will be removed with the closure.

BRIEF DESCRIPTION OF THE SEVERAL VIEWS OF DRAWINGS

DETAILED DESCRIPTION

Figure 1:
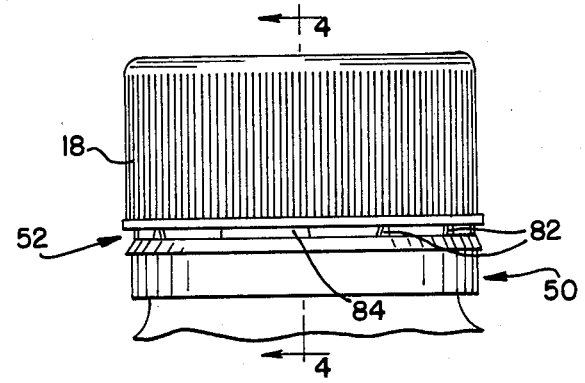
FIG. 1 is a side elevational view of the container constructed in accordance with the teachings of the present invention.
Figure 3:
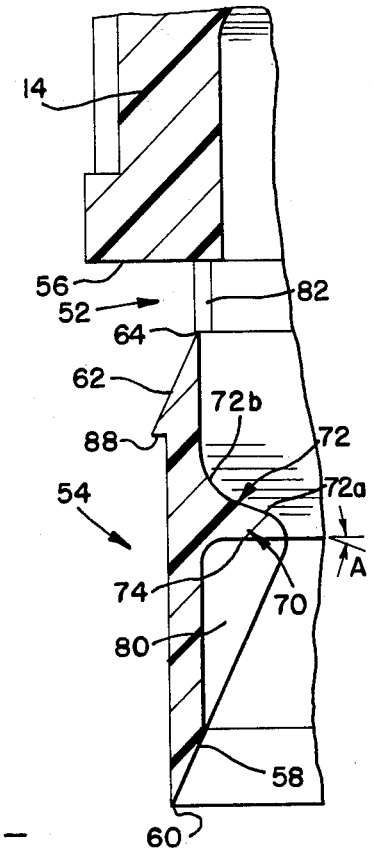
FIG. 3 is an enlarged cross-sectional view of the tamper-evident band.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 4:
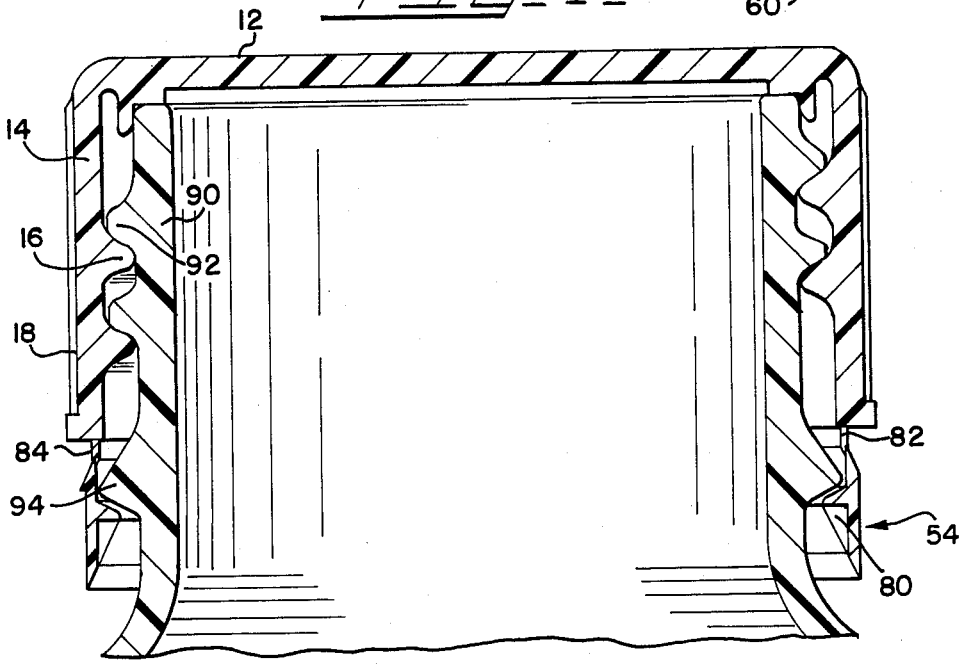
FIG. 4 is a cross-sectional view, as viewed along line 4—4 of FIG. 1, showing the closure on a container neck.

FIG. 4 shows a cap closure, generally designated by reference numeral 10, that is particularly adapted as a closure for a plastic bottle that has a clearly-defined neck finish thereon. The closure 10 consists of a generally circular top wall 12 with a depending annular skirt or side wall 14 extending from the periphery of the top wall. The inner surface of the side wall has an integral thread 16 formed thereon, while the outer wall is serrated at 18 to provide a gripping surface.

Figure 2:
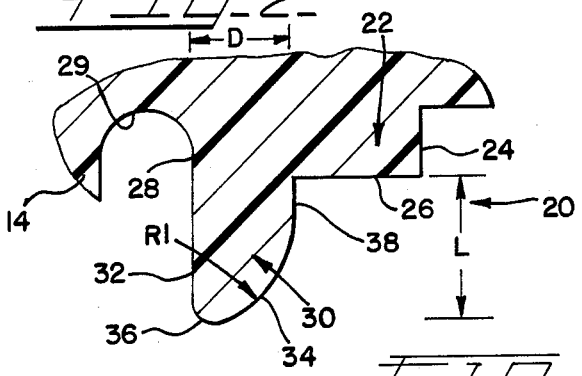
FIG. 2 is an enlarged fragmentary cross-sectional view of the sealing means.

According to one aspect of the invention, the lower surface of the top wall 12 has an annular sealing means 20 formed integral therewith and located adjacent the side wall 14. The sealing means is illustrated in detail in FIG. 2 and consists of a generally rectangular annular rib or protrusion 22 that has an inner wall 24, a bottom wall 26 and an outer wall 28. The outer wall 28 merges with the inner surface of the side wall 14 through an arcuate radiused annular portion 29.

The sealing means also includes an annular projection 30 that is integral with the bottom wall 26 and has an outer wall or surface 32 that defines an integral extension of outer wall 28 of rib 22. The projection 30 also has an arcuate inner wall 34 which merges with the outer wall 32 through a small radiused portion 36 at the lower end or tip of the projection 30. The inner wall 34 has a flattened portion 38 which extends substantially parallel to the axis of the closure and extends substantially perpendicular to the bottom wall 26 of rib 22. The projection 30 has a cross-sectional thickness which approaches the length of the projection so as to minimize the amount of deflection that the projection will experience while the closure is threaded onto the container neck.

Thus, the projection has a thickness D between planar portion 38 and outer wall 32 which has a dimension that is equal to approximately 0.030 inch, while the length of the projection L is about 0.040 inch. The arcuate inner wall has a radius R1 which is less than the length of the projection and is preferably on the order of about 0.034 inch and the radius of the rounded end 36 is about 0.005 inch. The radial dimension between the inner and outer walls 24 and 28 of the rib is more than twice the dimension D so as to provide sufficient rigidity for the projection 30 to prevent any significant deflection of the projection 30 while the closure is being threaded onto the container neck. Also, the annular diameter of the planar inner wall portion 38 is approximately equal to the minimum diameter of the external surface of the container neck so that extended surface contact is maintained between the planar portion 38 and the exterior surface of the container neck when the closure is fully threaded onto the container neck, even if the neck finish has a minimum diameter. If the container neck has an external diameter that is slightly larger, the outer edge of the neck will engage the arcuate portion 34 and will slide along the arcuate portion until the protrusion engages the top surface of the neck. Thus, the arcuate portion 34 and the linear portion 38 of projection 30 will be deformed somewhat to conform to the peripheral surface of the container neck and provide extended surface contact with the exterior of the neck.

According to a further aspect of the invention, the closure 10 also includes a tamper-evident band 50 that is located below the lower end of the skirt portion 14 and is integrally joined thereto by a frangible connection 52. The tamper-evident band 50 consists of a generally annular main body 54 that has an upper edge and a lower edge. The upper edge is connected to the lower edge 56 of the side wall 14 through the frangible connection 52. The main body 54 has a lower tapered edge 58 which tapers to a point 60 while the upper edge 62 is likewise tapered to a point 64. The outer surface of the main body 54 has a horizontal shoulder 88 that is utilized in removing the closure and band from the mold and prevent severing of the frangible connection.

The elongated body 54 has an inwardly-directed bead 70 that defines an upwardly-directed arcuate shoulder 72 and a lower flat horizontal wall 74. The inner edge 76 of the annular bead is rounded off and ramp means 80 extend between the inner edge 76 and the tapered portion 58 of the lower edge of the main body. The arcuate shoulder 72 has a lower inclined portion **72*a* that defines an angle A with respect to a horizontal plane and an arcuate surface 72*b* which merges with the inner wall of the band. The angle A is preferably on the order of about 25°, while the radius of arcuate surface 72*b*** is about 0.023 inch.

The ramp means is in the form of a plurality of circumferentially-spaced triangular supports, the inner surface of which defines an extension of the inclined lower end portion 58 and merges at its upper end with the rounded portion 72. Thus, the triangular supports or ramp means 80 are utilized to guide the inwardly-directed bead 70 over a rib defined on the container neck, as will be described later.

The frangible means 52 consists of a plurality of circumferentially-spaced tear tangs 82 that have a thickness which is significantly smaller than the thickness of the side wall 14 and is also smaller in cross-section than the thickness of the main body 54. In the illustrated embodiment, there are approximately 10 circumferentially-spaced connecting members 82, and one permanent connecting member 84 has a larger circumferential dimension than the remaining connecting members, for a purpose that will be described later.

The configuration of the tamper-evident band, particularly the inwardly-directed bead, aids in removing the closure from the mold in an efficient manner without destruction of the tangs. Thus, the main body has shoulder 88 formed thereon that is spaced about the bead 70. In removing the closure from the mold, a mold element engages the shoulder 88 and the lower surface 56 of the skirt to maintain the integrity of the tear tangs. Since the shoulder is located well above the bead 70, the inclined and arcuate surfaces **72*a* and 72*b*** will ride on the associate mold surface and the main body will be expanded to clear the mold surface. It should be noted that the wall thickness of the main body is about 0.015 inch and the bead has a radial dimension of about 0.035 inch, the main body will readily deflect to accommodate removal of the bead from the mold.

In assembling the closure 10 onto the container neck 90 having an external thread 92, the inclined surfaces or ramps 80 will slide along the external thread 92 of the container neck and will then engage rib 94 on the container neck 90 and the band 50 will have sufficient resiliency to expand and slide over the rib formed on the container neck. The upwardly-directed shoulder 72 will then engage the underside of the rib 94. At the same time, the thread 16 will engage the cooperating thread on the external surface of the container neck and the inner arcuate surface of the projection will engage the outer edge of the upper surface of the plastic container neck. The projection has sufficient rigidity to prevent any significant deflection and, if the diameter of the neck is slightly larger than the minimum diameter, the inner surface will be deformed to conform to the outer peripheral surface of the container neck. As the closure is further threaded onto the container neck, the bottom wall of the rib 22 will engage the upper flat surface of the container neck and will thereby provide additional sealing capability between the closure and the neck.

After the closure is on the container, removal torque applied to the closure will produce frictional forces between the neck rib 94 and the bead 70 to sever the small frangible connecting members 82. However, the larger connecting member 84 will have sufficient strength to overcome the frictional forces and will keep the band connected to the closure and be removed with it. This feature is important in packaging certain products. For example, if the product is oil, a band retained on the container could dislodge while the oil is being poured into an engine, which would ruin the engine.

While specific embodiments have been illustrated and described, numerous modifications come to mind without significantly departing from the spirit of the invention and the scope of protection is only limited by the scope of the accompanying claims.

I claim:

1. A linerless cap closure comprising a generally circular top wall with a depending annular skirt having an internal thread adapted to engage with an external thread on a container neck and sealing means depending form a lower surface of said top wall adjacent said annular skirt, said sealing means including an annular protrusion integral with said lower surfaces and being generally rectangular in cross-section and having an outer wall, an inner wall and a flat bottom wall, and an annular projection integral with said bottom wall of said protusion, said projection having an outer wall extending substantially parallel to the closure axis and an arcuate inner wall merging with said outer wall through a reduced radiused portion, said inner wall of said projection merging with said flat bottom wall of said protusion intermediate said inner and outer walls of said protrusion and extending substantially perpendicular to said bottom wall at a point of intersection so that upon threading of said closure onto a threaded container neck, the projection will engage and slide along an outer edge of the container neck to provide a side seal and said flat bottom wall of said protrusion will engage on a top surface of said container neck to produce an additional top seal.

2. A linerless cap closure as defined in claim 1, further including a tamper evident band extending below said annular skirt and connected thereto by a frangible connection, said band including a main body having an inwardly-directed bead intermediate uppper and lower edges, said bead defining an upwardly-directed shoulder adapted to engage an underside of a rib on the container neck, and ramp means extending between an inner edge of said bead and a lower edge of said main body for guiding said bead over said rib on said container neck while the closure is threaded onto the container neck.

3. A linerless cap closure as defined in claim 2, further including a permanent connection between said band and said annular skirt so that said band is removed with said closure after said frangible connection is broken.

* * * * *